US006017586A

United States Patent [19]

Payn et al.

[11] Patent Number: 6,017,586

[45] Date of Patent: Jan. 25, 2000

[54] POLYMER MATERIAL AND METHOD OF MAKING SAME UTILIZING INERT ATMOSPHERE

[75] Inventors: Clyde F. Payn, Doylestown, Pa.; James Temple, Princeton, N.J.

[73] Assignee: Catalyst Group, Inc., Spring House, Pa.

[21] Appl. No.: 09/026,475

[22] Filed: Feb. 19, 1998

[51] Int. Cl.[7] ..... B05D 3/00; B05D 5/00

[52] U.S. Cl. ..... 427/372.2; 427/211; 427/277; 427/288; 427/394

[58] Field of Search ..... 427/372.2, 394, 427/428, 277, 288, 24

[56] References Cited

U.S. PATENT DOCUMENTS

| | | | |
|---|---|---|---|
| 4,612,155 | 9/1986 | Wong et al. | 264/176 R |
| 4,943,473 | 7/1990 | Sahatjian et al. | 428/245 |
| 5,021,510 | 6/1991 | Vroomans | 525/285 |
| 5,525,695 | 6/1996 | Lai et al. | 526/352 |
| 5,599,857 | 2/1997 | Allen et al. | 524/3 |
| 5,616,664 | 4/1997 | Timmers et al. | 526/127 |
| 5,705,565 | 1/1998 | Hughes et al. | 525/65 |
| 5,741,868 | 4/1998 | Winter et al. | 526/127 |
| 5,844,055 | 12/1998 | Brandt et al. | 526/127 |
| 5,891,530 | 4/1999 | Wright | 427/515 |

OTHER PUBLICATIONS

Elvers et al. (Editor), Ullman's Encyclopedia of Industrial Chemistry, vol. A16, pp. 53–54, Jan. 1990.

*Primary Examiner*—Diana Dudash
*Assistant Examiner*—Jennifer Calcagni
*Attorney, Agent, or Firm*—Caesar, Rivise, Bernstein, Cohen & Pokotilow Ltd.

[57] ABSTRACT

The present invention relates to a polymer/monomer (P/M) formulated system and method of making products from that system. The products have superior properties to and are substitutable for polyvinyl chloride (PVC) based products, as well as a variety of other polymeric coating systems. The present invention also relates to a process for the preparation of these P/M based coated substrates where the process takes place in a substantially inert atmosphere.

15 Claims, 7 Drawing Sheets

POLYMER MATERIAL AND METHOD OF MAKING SAME UTILIZING INERT ATMOSPHERE

BACKGROUND OF THE INVENTION

This invention relates to the preparation of polymer materials and a method of making those materials. Examples of such materials include, but are not limited to coated fabrics, extruded wire cables, pipes, blow-molded articles, etc.

There are a variety of procedures currently used to produce textiles coated with polymer based materials. Among these are spread coating, melt calendaring, and extrusion. Spread coating is particularly applicable to vinyl plastisol systems.

There are problems with materials made by spread coating of polyvinyl chloride (PVC) plastisol. They include difficulties stemming from the fact that these systems contain a liquid and that these systems are based on PVC. A system that contains a liquid plasticizer is subject to plasticizer loss from exudation, evaporation, or extraction. Such loss can reduce the physical properties of the coated fabric and result in a brittle material that is prone to cracking. The loss can also produce problems because of the presence of the escaped plasticizer. An example of this is the buildup of plasticizer on the interior surfaces of automobile windows in cars that are exposed to higher than ambient temperature. The presence of PVC in fabric systems can be detrimental. For example the hydrochloric acid generated by PVC in a fire can be detrimental. PVC containing materials are therefore excluded from certain applications.

The present invention allows for a coating material that can be applied in a manner similar to PVC spread coatings. The resulting fabric system, after curing, has no liquid component that could migrate or be extracted. It is also free of halogens and would not produce hydrochloric acid upon combustion. In addition, these new polymer products of the present invention would have enhanced physical and chemical properties relative to a PVC plastisol based system. Such improvements would include any combination of low temperature flexibility, weatherability, tensile properties (such as tensile strength at break, percent elongation at break, and tensile yield strength as measured in accordance with ASTM test method D638), abrasion resistance, and compression set (as measured by ASTM test method 395B).

Another important advantage of the system of the present invention is that with only modest modifications it can be run on a PVC plastisol coating line. This permits manufacturers of coated fabrics to use this new technology in their current production lines without major equipment modifications. The modest modifications needed would be in the area of preparing the casting fluid and in the temperature of the spread coating step.

Melt calendering is conventionally used in the application of polymeric coatings to fabrics. The current invention provides significant advantages over conventional polymeric coatings in that process both in terms of processing advantages and in enhanced product properties. The viscosity of the coating material is a major factor in the speed at which fabric can be coated in a melt calendering operation. By providing lower viscosities of the coating material, the present invention can be used to increase the rate of fabric coating and thus reduce the manufacturing cost. The viscosity of the coating material also has an effect on the forces that tend to push the calendering rolls apart. This action tends to produce differences in the thickness of the coating delivered to the fabric substrate. Coating produced at the center of the roll tends to be thicker than the coating at the edge of the roll. Lowering the viscosity of the coating fluid will reduce this difference and thus lead to a fabric with a more uniform coating.

The lowering of viscosity can also be used to increase the physical properties of the final coated fabric. Very high molecular weight polyolefins have physical properties, such as strength, which make them desirable as fabric coatings. In conventional melt processing their viscosity would be too high to allow fabric coating, without resorting to temperatures which would degrade the polymer and the fabric. Such a very high molecular weight polyolefin can be formulated into a coating fluid with an acceptable viscosity using this invention.

The resulting cured system would have enhanced physical properties, in part due to the elevated molecular weight of the base polymer, and in part due to the benefit obtained from the chemical bonding and polymerization of the liquid components during curing. These improvements in the base properties of the base polyolefin would include any combination of improved impact strength, stronger bonding to the fabric, improved printability and paintability, and better abrasion resistance.

Extrusion coating is a common technique used to apply a polymeric material to a fabric substrate. This process typically involves the generation of a high temperature melt that is forced through a die at a high shear rate. The dies needed to coat wider sheets, such as two meters in width, require the polymer melt to undergo high temperature and a high shear rate. This requires high pressure and expensive equipment. This process can also lead to polymer degradation.

The present invention greatly reduces the temperature, pressure and shear rate requirements needed to practice extrusion coating. This has the benefit of allowing the use of less expensive equipment and reduces the possibility of degradation of the polymeric system due to exposure to excessive temperature or shear rate. As in the calendering case, the physical properties of the resulting polymer coated fabric can be enhanced through the use of higher molecular weight polymers than would be possible to use in the conventional process.

The resulting cured system would have enhanced physical properties, in part due to the elevated molecular weight of the base polymer, and in part due to the benefit obtained from the chemical bonding and polymerization of the liquid components into a superior cross-linked network during curing.

EP AO 605 831, dated Jul. 13, 1994 to Mitsubishi Petrochemical Co. discloses the use of a copolymer of ethylene derived from using metallocene catalyst for food wrap stretched films, with specific thicknesses and properties.

WO A 94 09060, dated Apr. 28,1994 to Dow Chemical Co. discloses the use of metallocene catalyst derived linear ethylene polymers as a film for packaging purposes, with specific additives and properties.

WO A 96 04419, dated Feb. 15,1996 to Forbo-Nairn Ltd. discloses the use of single-site catalyzed polyalkene resin with various additives for the production of sheet materials for rigid floor coverings. It has now been discovered that metallocene catalyzed polyolefins in combination with a different liquid monomer components can be formulated with additives into superior flexible coated fabric products.

WO A 96 11231, dated Apr. 18, 1996 to Henkel discloses a mixture of polymers and unsaturated carboxylic acids, alcohols with plasticizers which are not dissolved in the polymer phase below the film forming temperature. Whereas the current polymer/monomer (P/M ) invention is devoid of a plasticizer.

SUMMARY OF THE INVENTION

Recently, new synthetic methods have been developed for preparing polyvinyl chloride (PVC) substitute products in various different product applications because consumers and regulators have considered that the use of PVC in certain applications is undesirable, particularly if these products may be subjected to combustion, forming chlorine derivatives or exposure to food where the leachability of plasticizer, may cause toxicity.

In accordance with the present invention, the polymer/monomer allows for a coating system that can be applied in a manner similar to PVC spread or plastisol coatings and is substitutable in existing spread coating, melt calendaring or extrusion processing equipment, yet produces a resulting fabric system, after curing, that has no liquid component that can migrate or be extracted and is also free of halogens that would produce hydrochloric acid upon combustion. In addition the polymer/monomer system of the present invention can be reformulated and tailored to provide enhanced physical and chemical properties relative to a PVC plastisol systems such that the resulting fabric has improved flexibility, light stability, weatherability and durability (scuff resistance ) compared with existing products.

Also in accordance with this invention, the formulation and the properties targeted for the polymer/monomer system are substantially different from previously disclosed art (WO 96/04419) in that they are not rigid, rather they are designed to be highly flexible, suitable for impregnation so as to provide superior wetting capability with superior adhesion to fabrics and substrates that are coated, then cured.

The present invention is achieved by performing steps of the present invention under a blanket atmosphere of inert gas without exposure to adventitious air (oxygen).

DESCRIPTION OF THE DRAWINGS

Figure 1:
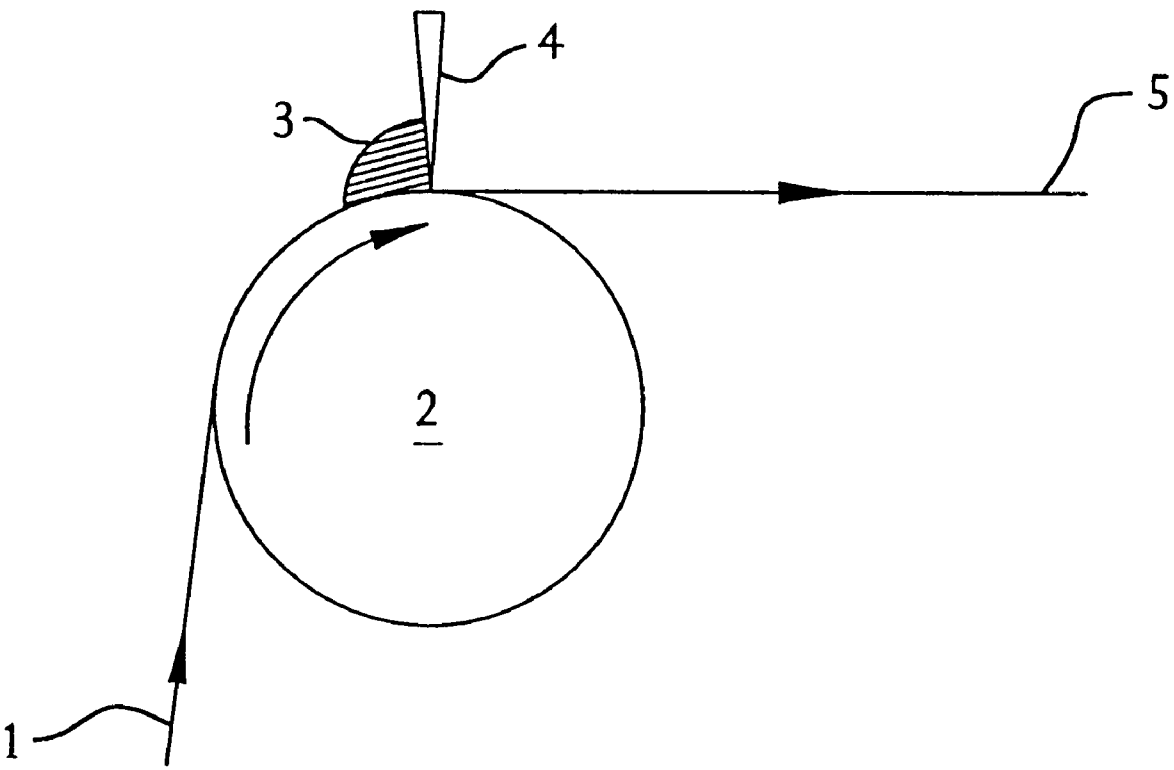
FIG. 1 shows the process of applying the P/M fluid to a fabric using a knife-over-roll coater.

Other objects and many attendant features of this invention will become readily appreciated as the same becomes better understood by reference to the following detailed description when considered in connection with the accompanying drawings wherein:

FIG. 1 shows the process of applying the P/M fluid to a fabric using a knife-over-roll coater. The uncoated fabric 1 is fed over a backing roll 2, at the top of this roll the P/M fluid 3, is applied onto the fabric. The distance between the knife 4, and the fabric determines the thickness of the coating that is delivered to the fabric as it moves under this knife to produce the coated fabric 5 that is removed from the roll.

Figure 2:
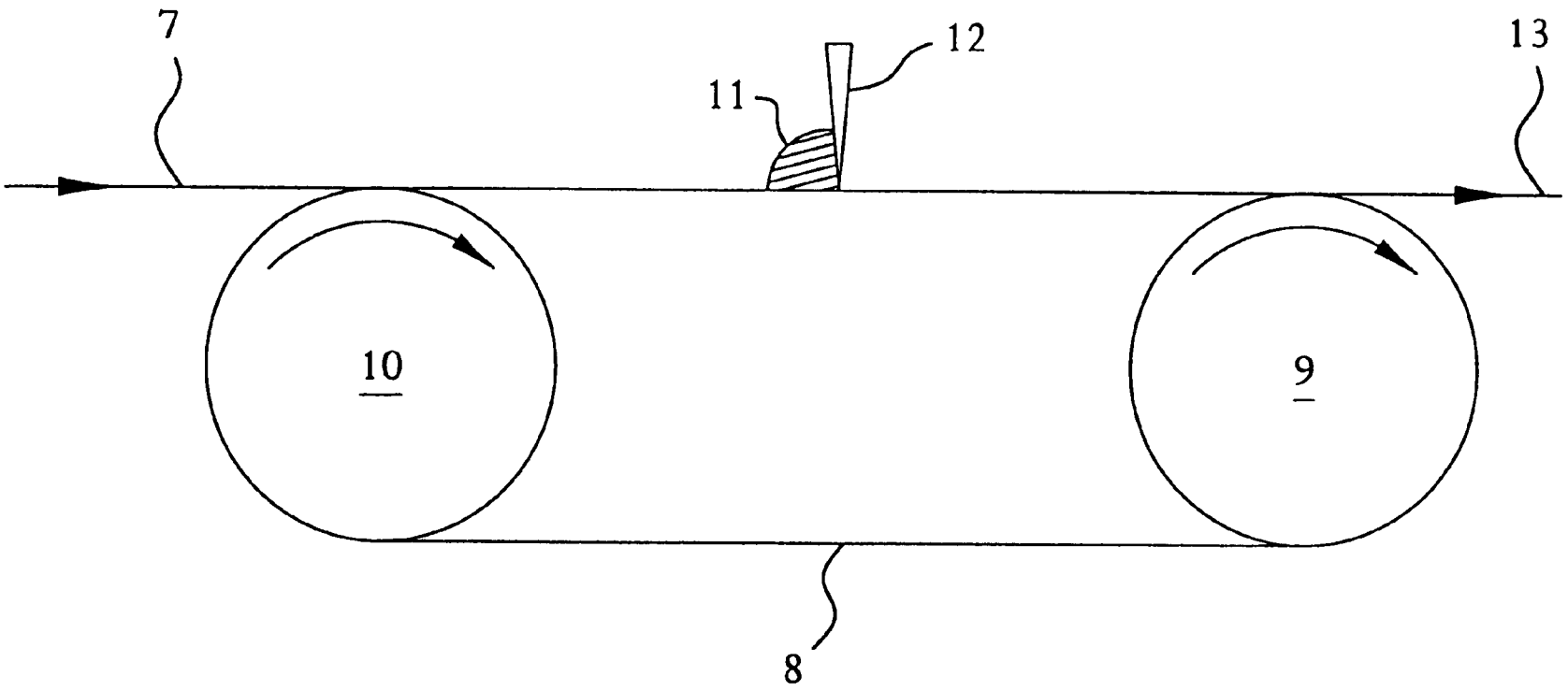
FIG. 2 shows the process of applying the P/M fluid to a fabric using a knife-over-belt coater.

FIG. 2 shows the process of applying the P/M fluid to a fabric using a knife-over-belt coater. The uncoated fabric 7, moves onto an endless belt 8, that connects a driven support role 9, and a free support roll 10. As the fabric moves across the top of this belt the P/M fluid 11, is applied to it just prior to a knife 12. The height of the knife above the fabric determines the thickness of the coating that is applied to the fabric as it moves under the knife. The coated fabric 13, is then removed from the belt as the belt moves down over the end roller.

Figure 3:
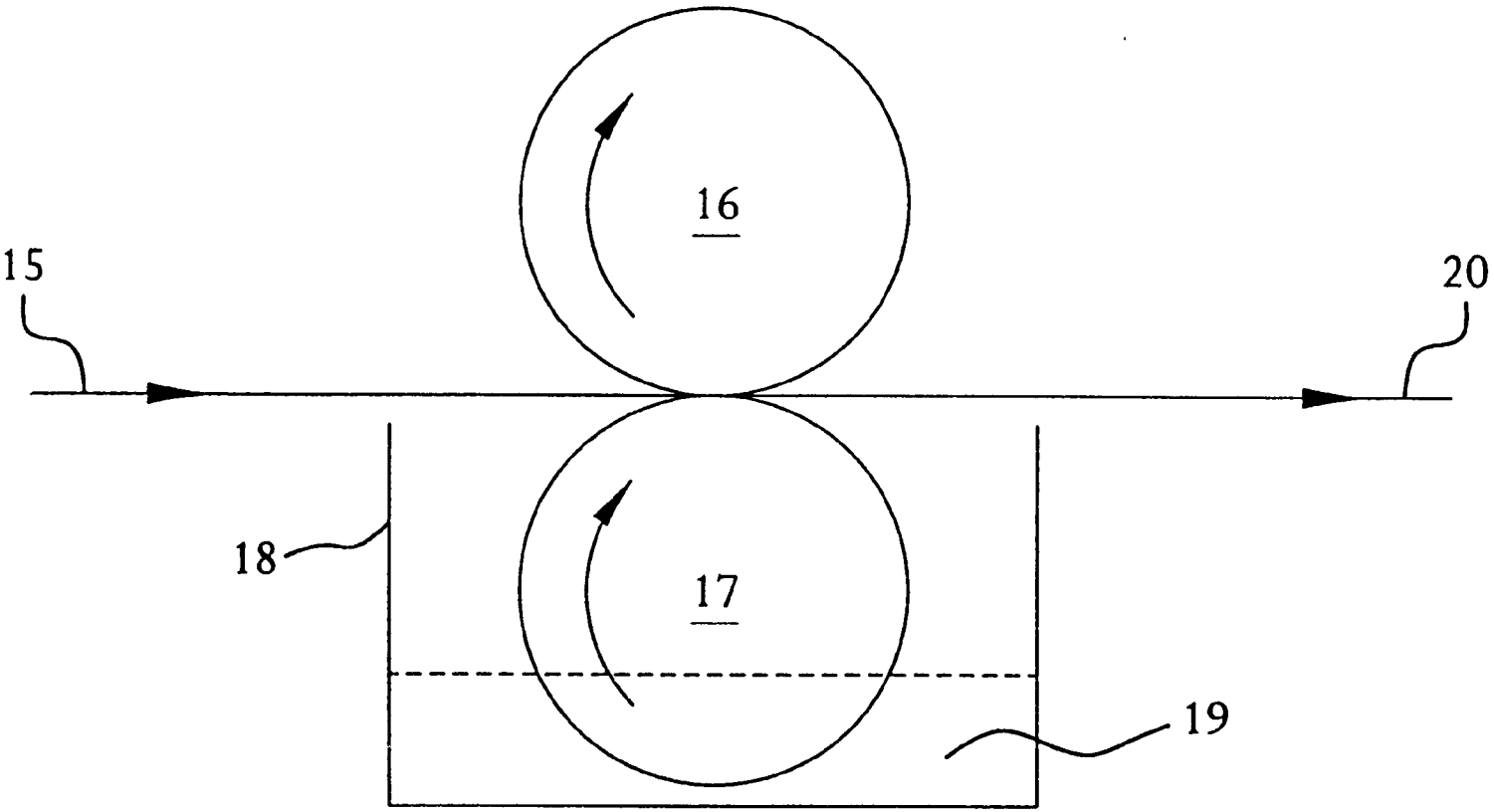
FIG. 3 shows the process of applying the P/M fluid to a fabric using a direct roll coater.

FIG. 3 shows the process of applying the P/M fluid to a fabric using a direct roll coater. The uncoated fabric 15, moves into the nip of two rolls, an upper roll 16, and a lower coating roll 17. The lower roll projects into a container 18, that holds the P/M fluid 19. Roll 17 picks up an amount of this fluid and transports it to the nip area where the fabric is passing between the two rolls. The distance between the two rolls determines the amount of P/M fluid that is coated onto the lower surface of the fabric. The coated fabric 20 moves away from the nip of the rolls on the opposite side of the coater.

Figure 4:
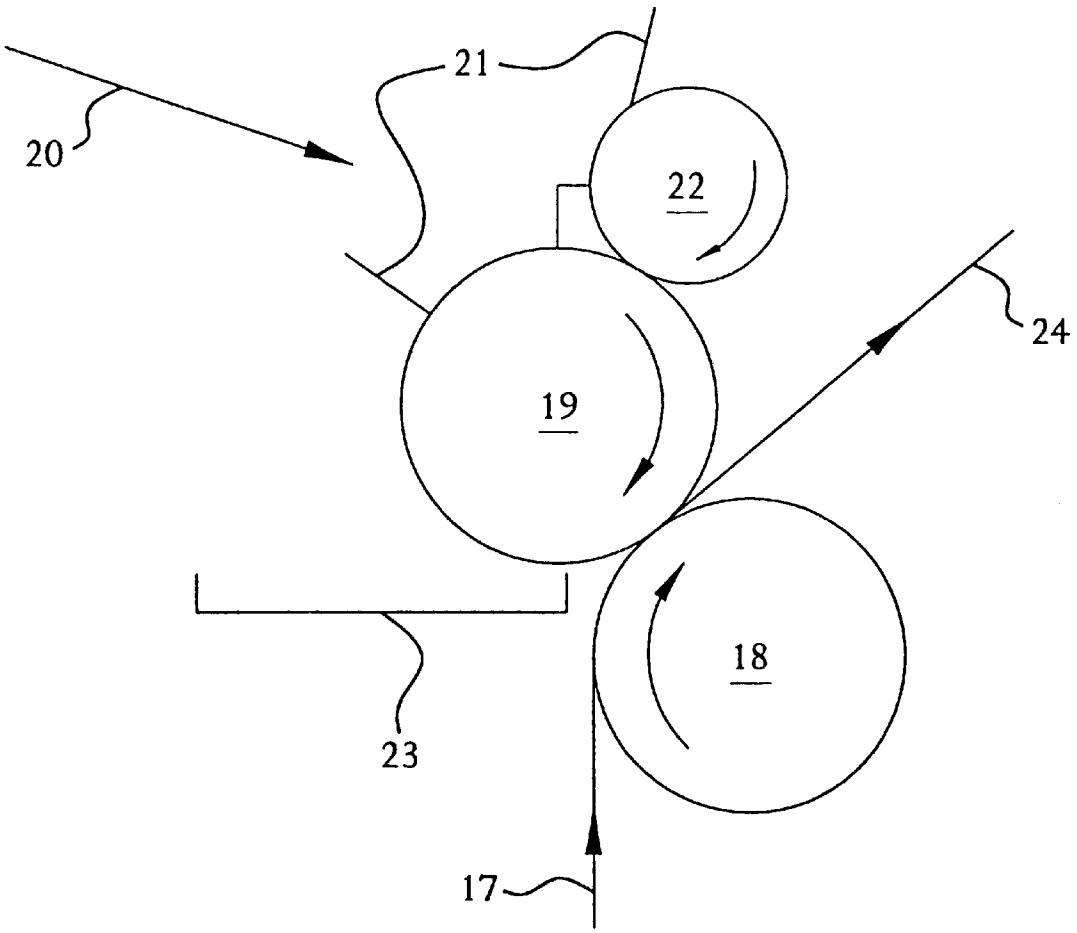
FIG. 4 shows the process of applying the P/M fluid to a fabric using a nip fed reverse roll coater.

FIG. 4 shows the process of applying the P/M fluid to a fabric using a nip fed reverse roll coater. The uncoated fabric 17, moves between a backing roll 18, and a casting roll 19. The P/M fluid 20, is applied to the casting roll between two doctor blades 21. The fluid is metered onto the casting roll by traveling between the casting roll and a metering roll 22. The gap between these two rolls controls the amount of the P/M fluid that moves forward on the casting roll to contact the fabric at the nip between the casting roll and the backing roll. At that point a coating of the P/M fluid is transferred to the top surface of the fabric. A pan 23, collects any excess P/M fluid that might fall from the casting roll after it passes through the nip with the backing roll. The coated fabric 24, is drawn away from this nip between the backing roll and the casting roll.

Figure 5:
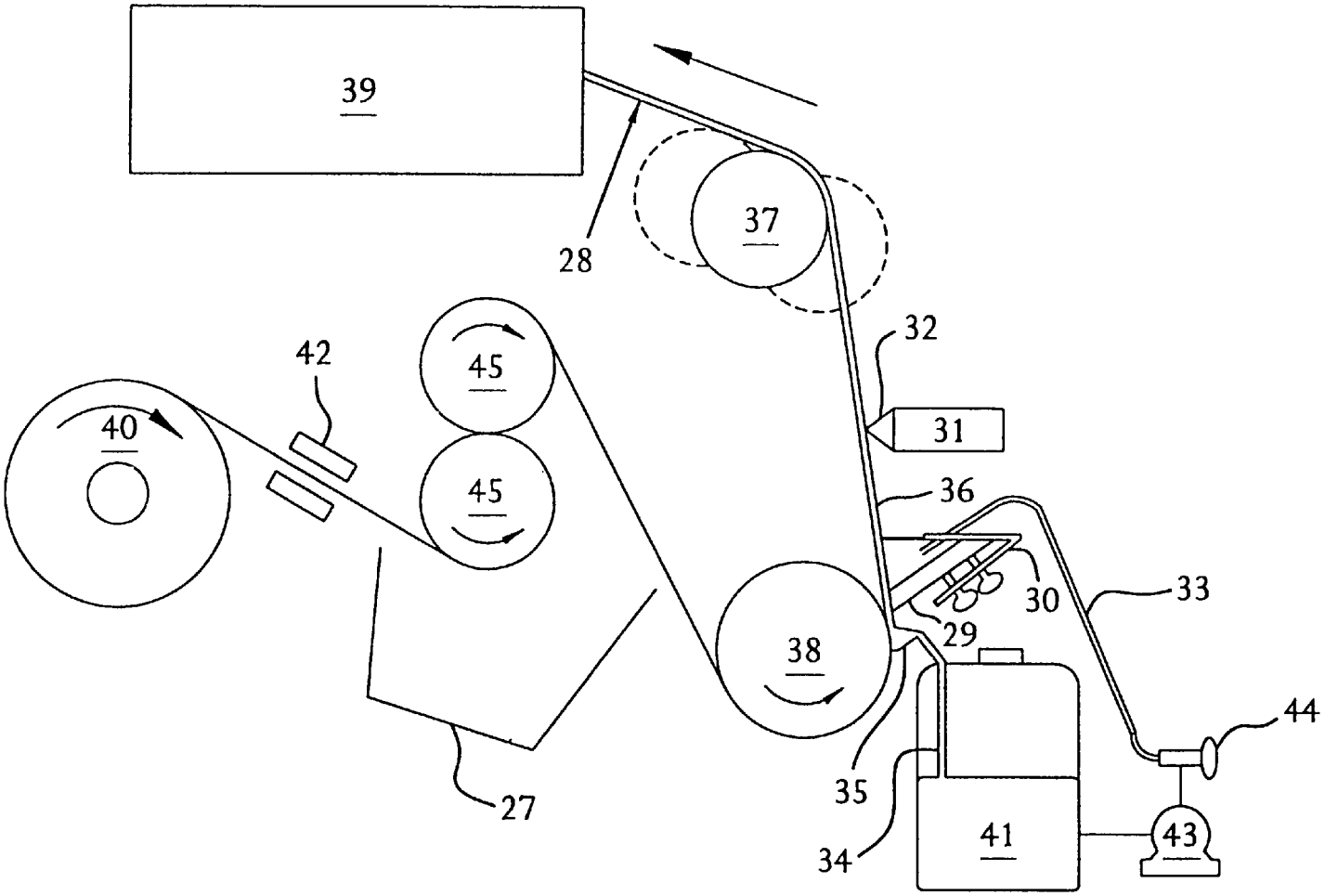
FIG. 5 shows the process of applying the P/M fluid to a fabric using a rod coater.

FIG. 5 shows the process of applying the P/M fluid to a fabric using a rod coater. The uncoated fabric 27, passes from the unwind roll 40, through the web guide sensor 42, around the s-wrap rolls 45, and around the back-up roll 38. At the backup-roll the fabric comes in contact with the P/M fluid 41, at a coating puddle 35. This coating puddle is formed by an edge dam 29, a coating pan 30, and the fabric. The P/M fluid is moved by a pump 43, to the coating puddle through a control valve 44, and the supply line to the pan 33. The fabric with run back from the metering rod 10, moves from the coating puddle to coating rod 32. The coating rod is held against the fabric by the rod support rod 31. The coated fabric 28, moves from coating rod over an adjustable roller 37, and into the curing over 39.

Figure 6:
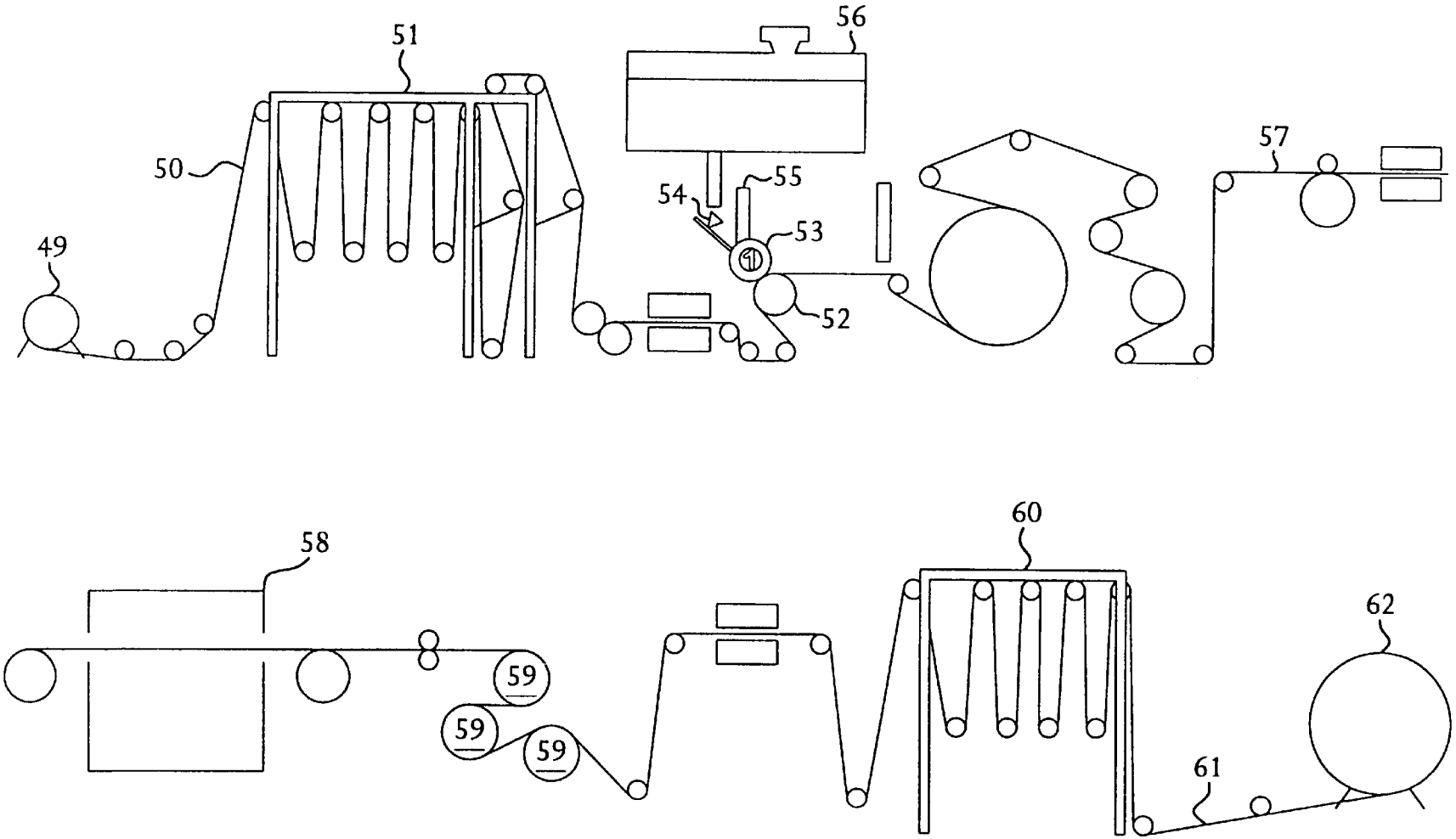
FIG. 6 shows the process of manufacture of a cured coated fabric using a knife-over-roll reverse roll coating process.

FIG. 6 shows the process of manufacture of a cured coated fabric using a knife-over-roll reverse roll coating process. The uncoated fabric 50, moves from the unwind drum 49, through an accumulator 51, to a backing roll 52. At the nip between the backing roll and the casting roll 53, the P/M fluid is transferred from the casting roll to the fabric. The P/M fluid 54, is metered onto the casting roll by passing under the knife 55. The gap between the knife and the casting roll determines the thickness of the coating. The P/M fluid is prepared in a continuous mixer 56, and transferred to the casting roll. The uncured coated fabric 57, moves from the coating operation to a curing oven 58. The coating cures in a free radical polymerization while passing through this oven. From the oven the fabric passes over cooling rolls 59, through an accumulator 60, and then the cured coated fabric 61, is wound upon the re-wind roll 62.

Figure 7:
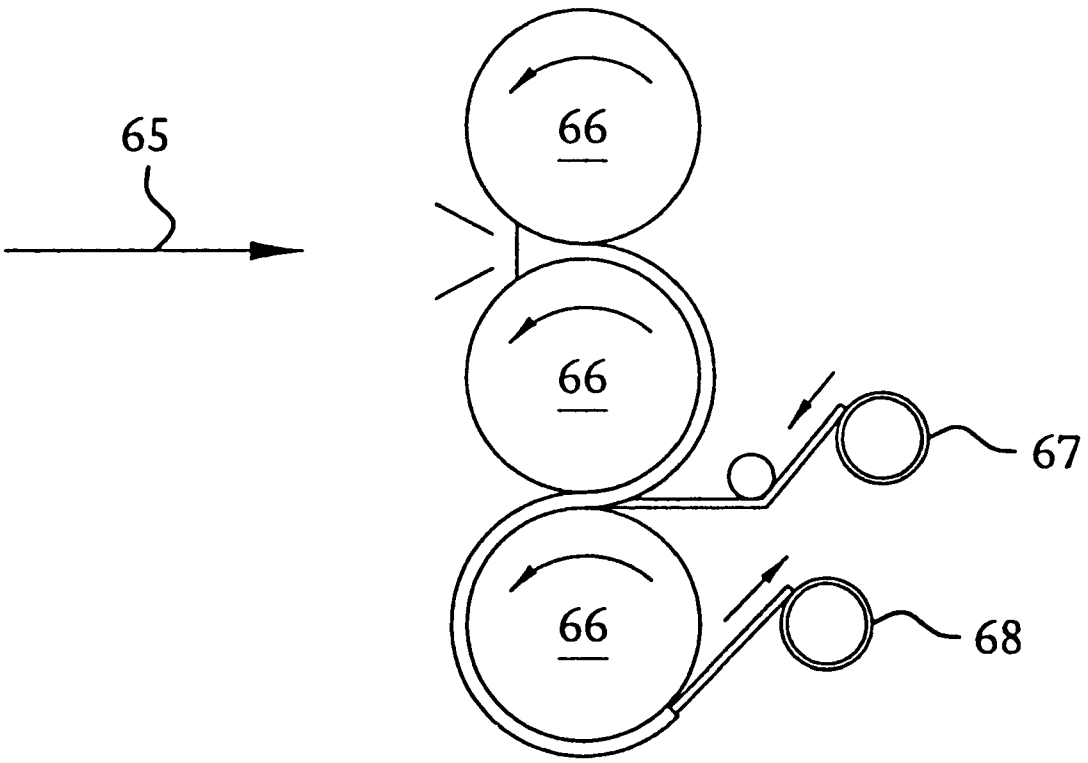
FIG. 7 shows the process of applying the P/M fluid to a fabric using a melt calendering coater.

FIG. 7 shows the process of applying the P/M fluid to a fabric using a melt calendering coater. The P/M fluid 65, is introduced into a three roll calendering stack 66. The amount of P/M fluid that is carried forward on the mill rolls is determined by the gap at the nip between the first two rolls. Uncoated fabric 67 is introduced into the calendering roles between the second and third rolls. At the nip between these rolls the P/M fluid coats the fabric. The coated fabric 68 is the removed from the bottom of the third roll.

For superior results, the application and curing should be carried out under a blanket atmosphere of an inert gas (including but not limited to nitrogen, argon, helium, etc.) without exposure of the support (if any e.g., fabric) or P/M fluid (melt) to adventitious air (oxygen). In particular, the curing ovens shown in FIG. 5 and FIG. 6 should be inert gas ovens with forced circulation.

DETAILED DESCRIPTION OF THE INVENTION

Polymer/Monomer (P/M) Fluid Preparation

This invention includes several different processing steps that result in the effective preparation of a superior coated fabric. Such coated fabrics being suitable for such uses in upholstery, convertible tops, truck covers, outdoor furniture, tarpaulins, ground cloths, roofing, conveyor belts, gaskets, wallcovering, curtains, book coverings, clothing, awnings, signs, tents, luggage, shoes, and the like. The exact details of the these steps are tailored for the general nature of the application process. These application processes include spread coating, melt calendering, extrusion, and other ways know to one skilled in the art.

The basic components involved in the preparation of the fluid are: preformed polymers, polymerizable liquids, initiators, and optionally a wide range of additives such as fillers, fibers, blowing agents, fire retardants, processing aids, impact modifiers, dyes, pigments, and the like.

The use of an initiator is needed for this invention when thermal or photochemical curing is desired.

The curing process involves the free radical polymerization of the liquid. Initiators are not essential if high energy radiation, such as electron beams, gamma rays or other forms of high energy radiation are used to cause the curing to occur. A particularly useful procedure for the preparation of this fluid is to add the initiator after all other components have been combined and thoroughly mixed, most desirably under inert conditions. Adding the initiator in a liquid form to the polymer/monomer fluid and obtaining a uniform mixture by a low shear process, that does not produce "hot spots", is particularly advantageous. Such an approach reduces the risk of initiating the curing reaction too early in the process. If curing by a thermal process is desired, it is necessary to keep the temperature of the polymer/monomer/initiation fluid at least 20 degrees Celsius (C) below the curing temperature and desirable to keep this difference at 50 or more degrees C.

The preparation of the P/M fluid can be carried out in several ways including batch and continuous processes. The essential elements involve bringing the ingredients together in a closed system in an environment where heat and mixing can be applied in an atmosphere of inert gas (e.g., nitrogen). We have surprisingly found in the present invention that the presence of air (oxygen) has a strongly detrimental effect on the P/M polymerization process so that it is advantageous to exclude air as much as possible, especially from the initial stages of the process.

When initiating free radicals are formed (e.g., from thermal decomposition of peroxide), these free radicals add to residual olefinic bonds in the polyolefin to give polymer chain radicals with the radical site initially localised on a terminus of the site of the reactive double bond in the polymer chain. (Metallocene polyolefins have olefinic double bonds in exceptionally reactive and available mobile terminal positions). Abstraction of hydrogen from saturated carbon at positions on the polymer chain can similarly result in polymer chain free radical formation.

In the present invention, when oxygen is excluded, these polymer chain radicals participate in carbon—carbon bond formation in an array of polymerization, grafting and cross-linking processes to form superior cross-linked networks involving both other polyolefin chains and reactive functional groups in the polymerizable liquid.

There is an equilibrium concentration of polymer chain radicals. The actual concentration of these radicals reflects the balance of the processes leading to radical formation and of the processes leading to radical consumption. The position of this equilibrium is therefore affected by the concentration of molecular oxygen present and by the relative mobilities (diffusion), inherent reactivities and concentration of the available reactive monomers. When molecular oxygen is present in significant concentrations, oxygen can diffuse rapidly throughout the melt and react efficiently with polymer free radicals as they are formed, resulting in fewer polymer radical sites participating in the desired constructive new carbon—carbon bond forming processes.

Where the added monomers are relatively unreactive, the sensitivity to the presence of oxygen is high. Where the added monomers are exceptionally reactive, sensitivity to the presence of oxygen is lower. Clearly the concentration of oxygen should ideally be as low as possible. The present invention considers mostly physical methods for the removal or dilution of oxygen, e.g., by vacuum, by working under an inert gas atmosphere.

The extent of the enhancement of physical properties reflects the efficiency with which air (oxygen) has been excluded, especially during the initial stages of the process.

It is known that molecular oxygen, particularly in the presence of a transition metal catalyst can oxidize organic materials in efficient reactions (Reference: "Oxidations in Organic Chemistry", M. Hudlicky, ACS Monograph 186, page 4 and references cited). It is noted that judicious application of such chemical reactions could be used to consume molecular oxygen and thus lower its concentration.

A batch process could involve the use of one of the many types of commercial mechanical mixers used in the plastic or rubber industry, for example a Brabender internal mixer (C W Brabender Instruments Inc., South Hakensack, N.J.). The polymer, monomer, and optional ingredients could be charged to the enclosed mixing chamber, under nitrogen or other inert atmosphere, the mixture heated and mixed with the two spiral-shaped rotors, and when a uniform fluid has been produced, this can be removed through the bottom discharge port. An initiator could be added ideally under inert atmosphere and mixed into the P/M fluid just before discharge from the Brabender.

For superior results, the ingredients could be subjected to one or more cycles of vacuum degassing followed by equilibration under an inert gas atmosphere, prior to storage under a positive pressure of inert gas. Ideally transfer of the degassed materials to the mixing chamber (which is itself under a blanket of inert gas) takes place without exposure of any of the materials to adventitious oxygen.

The P/M fluid can be made in a continuous manner using a variety of devices such as an extruder or a continuous mixer, ideally under inert atmosphere. In an extruder, such as a twin screw Welding Engineers (Welding Engineers Inc., Blue Bell, Pa.), the polymer and solid additives would be added at the feed throat at the initial section of the extruder, ideally under inert atmosphere. The monomer and liquid additives could be added at one, or more, liquid addition ports in subsequent barrel sections ideally under inert atmosphere. This would produce a uniform P/M fluid at the discharge end of this device. The initiator could be added at the very end of the extrusion operation.

Ideally all of these materials, additives, etc. would have been thoroughly degassed (for instance as described above) and added under a blanket atmosphere of inert gas without exposure of any of the ingredients or melt to adventitious air (oxygen). A well-mixed initiator in P/M fluid could be obtained by injection of the liquid initiator into the P/M fluid stream just before an in line motionless mixer, for example, a Komax in-line mixer unit (Komax Systems, Inc., Wilmington, Calif.) ideally under inert atmosphere.

In continuous mixers, such as the range produced by Farrel (Farrel Corp., Ansonia, Conn.), good P/M fluids can also be produced. This system resembles a Brabender, but has the ability of taking a continuous feed of solid and liquid ingredients and producing a continuous stream of fluid from its discharge port.

Again, ideally all of these materials, additives, initiators, etc. would have been thoroughly degassed (for instance as described above) and added under a blanket atmosphere of inert gas without exposure of any of the ingredients or melt to adventitious air (oxygen). The chamber and the internal volumes of the mixer would be under inert gas atmosphere.

The P/M fluid has three major components and many possible optional components. The major components are: preformed polymer component(s), liquid monomer component(s) and optionally an initiator component. Each of these components can be a single compound or a mixture of two or more compounds. Based upon the content of the three major components, the weight percent of the polymer components is between about 40% and 95%, preferably between 50% and 80%; the weight percent of the monomer component(s) is between about 5% and 60%, preferably between 20% and 50%; and the weight percent of the initiator component (if used) is between about 0.01% and 10%, preferably between 0.1% and 5%.

The range of polymers and elastomers that can be used in accordance with the present invention includes but is not limited to polyolefin polymers, copolymers, and terpolymers prepared by any known polymerization technique—such as free radical, Ziegler-Natta, single-site catalyzed (metallocene) etc. Moreover with such polymers all of the possible polymer isometric structures can be utilized—such as straight chain, branched, stereoregular, etc. The hydrocarbon polymer chains may also be substituted in known manner, e.g., by the use of monomers containing substituents such as, but not limited to, for instance: aromatic (e.g., mononuclear, multinuclear, homonuclear, heteronuclear, heterocyclic), aliphatic (e.g. branched, linear), cyclic (bridged, unbridged), olefin, diene, triene, ester, silane, nitrile, ketone, carboxylic acid, amide, halogen and other chemical groups, functional monomers or by post-polymerization functionalization. Copolymers of ethylene and vinyl acetate monomers or polymers (such as Enathene, an ethylene/butyl acrylate copolymer from Quantum Chemical, Cincinnati, Ohio) would be examples of such materials.

Polymers prepared by extruder reaction grafting of monomers, such as maleic anhydride, to non-functional polyolefins would also be examples of polymers which could be utilized in the present invention. Polymer systems prepared by reactive combination or alloy formation of polyalkenes with other polymers, such as elastomers or rubbers, (for example: by the dynamic vulcanization process that is used to prepare "Santoprene", "Geolast", Trefsin", Dytron", Vyram", "VistaFlex" (Advanced Elastomer Systems, Akron, Ohio) and the like) are also examples of polymers that can be utilized in the present invention.

The liquid monomer compounds that can be used in accordance with the present invention are those that are fully miscible with the main polymer component(s).

In principle liquid monomers containing substituents such as, but not limited to, for instance: aromatic (e.g., mononuclear, multinuclear, homonuclear, heteronuclear, heterocyclic), aliphatic (e.g., branched, linear), cyclic (bridged, unbridged), olefin, diene, triene, ester, nitrile, ketone, carboxylic acid, amide, halogen and other chemical groups could be used, provided they are fully miscible with the polymer components. They need not, and would normally not, be solvents for any of the optional components such as inorganic fillers, impact modifiers, pigments, fire retardants, etc.

From the above discussion of mechanism, it is clear that if the polymeric carbon radicals lose their radical character for instance by abstraction of hydrogen from a proton source (e.g. from a phenol group in a thermal stabilizer or from a hydroxyl group present as a monomer substituent), the radical site is no longer able to participate directly in new carbon—carbon bond propagating processes. It is therefore crucial to avoid using polymers, monomers, fillers, and additives, etc. which can serve as sources of hydrogen to "kill" propagating radical sites.

Compounds that can make up the initiator component are those that produce free radicals in response to certain external conditions. These include both thermal and photochemical initiators. Thermal initiators are compounds that generate free radicals at elevated temperatures.

Many classes of free radical generators can be used, but materials in the peroxide, ketone peroxide, peroxydicarbonate, peroxyester, hydroperoxide, and peroxyketal families are of particular use. The characteristic needed in these compounds is that they do not generate free radicals, i.e., remain essentially dormant, and during the initial mixing, compounding, but do decompose to produce free radicals at an appropriate rate to initiate a polymerization of the monomer when the temperature is increased. For example, a material such as t-butyl perbenzoate has a half life of over 1000 hours at 100 degrees Centigrade, while having a half life of less than 2 minutes at 160 degrees Centigrade. In a P/M system containing such an initiator, it would be possible to process the system into the finished product form (i.e, shape or configuration) at 100 degrees Centigrade and then cure the system by a brief exposure at 160 degrees Centigrade.

Photochemical initiators are compounds that interact with radiation, such as ultra violet (UV) light to produce free radicals. Examples of such types of materials include benzildimethyl ketal, benzophenone, alpha hydroxy ketone, ethyl 4-(dimethylamino)benzoate, and isopropylthioxanthone. When such photochemical initiators are incorporated into a P/M fluid, the resulting "green" coated fabric can be cured by exposure to UV radiation.

When free radical generation is accomplished, (for instance by thermal decomposition of peroxide or through the use of photochemical initiators or by exposure to electron beam or by exposure to gamma radiation, etc.), it is generally highly desirable to work in a closed system under an inert gas atmosphere (e.g. nitrogen) in an environment where effective precautions are taken to prevent significant contact with atmospheric air (oxygen) in order that the resulting cured system has optimally enhanced physical properties. The presence of air (oxygen) has a strongly detrimental effect on P/M polymerization processes so that it is advantageous to remove and exclude air as much as possible, both from the starting materials, additives, initiators, etc., from the processing equipment including the feeders, etc.

Materials that promote cross-linking are an important optional ingredient for the P/M system. In most applications, cross-linking will enhance the desired properties of the polymer coated fabric. This class of additive will therefore be used in most application areas. Cross-linking of the polymer formed from the liquid monomer can be promoted by including polyfunctional monomers. Such materials contain two or more reactive functional groups that can be grafted onto a polymer or incorporated into a growing polymer chain in a free radical polymerization.

General formulas for some useful cross-linkable materials include, but are not limited to:

a. Organometallic systems $R_1R'_1MX_1Y_1$, where X and Y are alkyl or aryl residues containing alkyl or aryl residues containing chemical structures such as, but not limited to, olefinic, vinylic, acetylenic, diene, groups and/or chemical functional groups containing elements such as, but not limited to, sulphur, oxygen and nitrogen, such as, for example, (but not limited to), ester, nitrile, ketone, peroxide, and disulphide groups that can be grafted onto a polymer or incorporated into a growing polymer chain in a free radical process; M is Ti, Zr, Si or Sn; and R and R' are organic or inorganic residues that are relatively unreactive, X may be chemically identical to Y. R may be chemically identical to R'.

b. Organometallic systems $R_1MX_1Y_1Z_1$, where X, Y and Z are alkyl or aryl residues containing alkyl or aryl residues containing chemical structures such as, but not limited to, olefinic, vinylic, acetylenic, diene, groups and/or chemical functional groups containing elements such as, but not limited to, sulphur, oxygen and nitrogen, such as, for example, (but not limited to), ester, nitrile, ketone, peroxide, disulphide groups that can be grafted onto a polymer or incorporated into a growing polymer chain in a free radical process; M is Ti, Zr, Si or Sn; and R is an organic inorganic residue that is relatively unreactive. X, Y and Z may be chemically identical.

c. Organometallic systems $MX_1Y_1Z_1Z'$, where X, Y, Z' and Z are alkyl or aryl residues containing chemical structures such as, but not limited to, olefinic, vinylic, acetylenic, diene, groups and/or chemical functional groups containing elements such as, but not limited to, sulphur, oxygen and nitrogen, such as, for example, (but not limited to), ester, nitrile, ketone, peroxide, and disulphide groups that can be grafted onto a polymer or incorporated into a growing polymer chain in a free radical process; M is Ti, Zr, Si or Sn and R is an organic residue that is relatively unreactive; X, Y, Z and Z' may be chemically identical.

d. Organic systems $MX_1Y$, where X and Y are alkyl or aryl residues containing functional groups that can be grafted onto a polymer or incorporated into a growing polymer chain in a free radical process; and M is formally a hydrocarbon residue (substituted or unsubstituted, aliphatic or aromatic, homonuclear or heterocyclic, mononuclear or multinuclear). X may be chemically identical to Y.

e. Organic systems $MX_1Y_1Z_1$, where X, Y and Z are alkyl or aryl residues containing functional groups that can be grafted onto a polymer or incorporated into a growing polymer chain in a free radical process; and M is formally a hydrocarbon residue (substitute or unsubstituted, aliphatic or aromatic, homonuclear or heterocyclic, mononuclear or multinuclear). Y, Y and Z may be chemically identical.

f. Organic systems $MX_1Y_1Z_1Z'$, where X, Y, Z and Z' are alkyl or aryl residues containing functional groups that can be grafted onto a polymer or incorporated into a growing polymer chain in a free radical process; and M is formally a hydrocarbon residue (substituted or unsubstituted, aliphatic or aromatic, homonuclear or heterocyclic, mononuclear or multinuclear). X, Y, Z and Z' may be chemically identical.

Examples of such materials include, but are not limited to dibutyltindiacrylate, tetraallyltin, diallyldiphenylsilane, 1,3-divinyltetramethyldisiloxane, hexaalkoxymethylmelamine derivatives, triallylcyanurate, butylated-glycolurilformaldehyde, tetraethylene glycol dimethacrylate, trimethylolpropane triacrylate, dipentaerythritol pentacrylate, and divinyl benzene. Additional radical generators can be included that will promote cross-linking of the pre-existing polyolefin system and include but are not limited to include but are not limited to: peroxides, disulphides, azides, halogens and initiators such as benzildimethyl ketal which act as free radicals on exposure to sources of electromagnetic radiation such as UV.

It is of course essential that the cross-linking additives participate in constructive cross-linking bond forming processes during the reaction with polymer radicals. The cross-linking additive should therefore not have readily available protons that are easily abstracted by the polymer radical.

The two phases may be chemically bonded together through the use of several techniques. These techniques include the use of a high radical concentration to cause grafting of one phase to the other. Some of this will occur during the cross-linking of the polyolefin phase. A very useful technique is to use polyolefins that have been made using single-site catalysts. Such polyolefins have a terminal double bond that can participate in the free radical polymerization with the monomer.

When a metallocene catalyzed polyolefin is used in the P/M technology, a number of the preformed polyolefin chains will be incorporated into the growing polymer being formed from the liquid monomer.

Many optional ingredients can be added to the P/M system to tailor the coated fabric material to specific applications. These additives can be polymeric or non-polymeric and organic or inorganic. These types of materials include the full range of inorganic fillers (for example particles under 500 microns, preferably under 50 microns, of: gypsum, barite, calcium carbonate, clay, talk, quartz, silica, carbon black, glass beads—both solid and hollow, and the like), reinforcements (for example glass fibers, polymeric fibers, carbon fibers, wollastonite, asbestos, mica, and the like), fire retardants (for example: alumina trihydrate, zinc borate, ammonium polyphosphate, magnesium orthophosphate, magnesium hydroxide, antimony oxide, chlorinated paraffin, decabromodiphenly oxide, and the like), thermal stabilizers (for example thiobisphenols, alkylidene-bisphenols, di(3-t-butyl-4-hydroxy-5-ethylphenyl)-dicyclopentadiene, hydroxybenzyl compounds, thioethers, phosphites, phosphonites, zinc dibutyldithiocarbamate, and the like), photo stabilizers (for example: benzophones, benzotriazoles, salicylates, cyanocinnamates, benzoates, oxanilides, sterically hindered amines, and the like), dyes (for example: azo dye, anthraquinone derivatives, fluorescent bexzopyran dye, and the like), pigments (for example: nickel titanium yellow, iron oxide, chromoxide, phthalocyanine, tetrachlorothioindigo, monoazo benzimidazolone, and the like), and the like.

The polymeric additives would include impact modifiers (for example spherical elastomer particles of acrylic rubbers, butadiene rubbers, styrene-butadiene-styrene block copolymers, metallocene catalyzed polyolefin elastomers, and the like), processing aids (for example: plasticizers, lubricants, and the like), compatibilizers (for example block copolymers of the two polymers involved, graft polymers that incorporate types of polymers known to be compatible with the phases involved in the mixture, and the like), texturing aids (for example cross-linked polymer spheres in the 0.5 to 20 micron size range, and the like) and the like.

Gas inclusions in the form of either open or closed cell foam can also be part of the P/M system. This can be achieved both through the use of a chemical blowing agent (for example: azodicarbonamide, 5-phenyl tetrazole, p-toluene sulfonyl semicarbazide, p-toluene sulfonyl hydrazide, and the like) or through the mechanical incorporation of an inert gas, into the system.

From the above discussion of mechanism, it is clear that if the polymer carbon radicals lose their radical character for instance by abstraction of hydrogen from a proton source (e.g. from a hydroxyl group on the surface of a particle of filler), the radical site is no longer able to participate directly in new carbon—carbon bond propagating processes. It is therefore crucial to avoid using polymers, monomers, fillers, and additives etc. which can serve as sources of hydrogen to "kill" propagating radical sites.

The amount of optional ingredients, relative to the content of the three major components (polyolefin, monomer, and initiator) can range from 0.01 parts per hundred (PPH) to 900 PPH, preferably between 0.1 and 800 PPH.

P/M Fluid Application to Fabric

The application of the P/M fluid to fabric by a fluid spreading process, using the same type of equipment and techniques that are used to coat fabric with a PVC plastisol, is an effective way to use this invention to coat fabrics. The coating procedure can include knife-over roll—as shown in FIG. 1, knife-over-belt—as shown in FIG. 2, direct roll—as shown in FIG. 3, reverse role—as shown in FIG. 4, rod coater—as shown in FIG. 5, and the like.

In these processes fabric is metered from an unwind roll, through a coating station, and on to a take-up roll. The curing of the green P/M coated fabric can be done between the spreading station and the take-up roll, or it can be done in a subsequent operation. The curing can be carried out as a thermal process, a photo process (for example: with UV radiation or the like), or as a polymerization initiated by any one of several forms of high energy radiation (for example: gamma rays, electron beam, or the like).

For superior results, the application AND curing should be carried out under a blanket atmosphere of inert gas without exposure of the support (if any) or P/M fluid (melt) to adventitious air (oxygen). In particular, the curing ovens shown in FIG. 5 and FIG. 6 should be inert gas ovens with forced circulation.

To prepare P/M fluid, the ingredients are brought together in a closed system in an environment where heat and mixing can be applied and where effective precautions are taken to prevent significant contact with the atmospheric air (oxygen).

The P/M fluid for such a coating process can be prepared in batch (for example in a Banbury mixer (Farrel Corporation, Ansonia, Conn.)) or continuously (for example: in a Farrel continuous mixer (Farrel Corporation, Ansonia, Conn.)) and pumped to the spreading station.

For superior results, the ingredients could be thoroughly degassed (for instance by 1 or more cycles of vacuum degassing followed by equilibration under an inert gas atmosphere, prior to storage under a positive pressure of inert gas) and added under a blanket atmosphere of inert gas without exposure of any of the ingredients or melt to adventitious air (oxygen).

If a thermal polymerization is used to cure the P/M fluid, then a thermal initiator will be added and thoroughly mixed into the fluid under inert atmosphere before coating.

The temperature of the fluid in the mixer, the lines from the mixer to the coating station, and at the coating station needs to be maintained at a temperature high enough (for example between 70 degrees Centigrade and 150 degrees Centigrade, preferably between 90 degrees Centigrade and 120 degrees Centigrade) to keep the fluid at a spreadable viscosity (for example: between 50 and 1000 poise, preferably between 75 and 300 poise).

After application to the fabric, the coating fluid can be cured immediately, or allowed to cool to room temperature and cured at some future time most desirably under inert atmosphere. The P/M coated fabric in the "green" state has adequate strength and integrity to be handled, using conventional fabric processing equipment. A manufacturing process to produce a cured coated fabric using a knife-over-roll coating process, fed P/M fluid from a Farrel continuous mixer, and an in-line thermal cure is shown in FIG. 6.

For superior results, the blending, mixing compounding, coating, and curing should all be carried out under a blanket atmosphere of inert gas without exposure of any of the ingredients or melt to adventitious air (oxygen).

The application of the P/M fluid to fabric by a melt calendering type operation can also be used in accordance with the present invention to produce coated fabrics. This application process can be carried out ideally under inert gas atmosphere in any of the procedures currently used to melt calender coat fabrics with polymers (plastics and rubbers). Such an application of P/M fluid to a fabric using a calender coater is shown in FIG. 7.

There are significant process advantages to using P/M technology to coat fabric, relative to the use of conventional polymer melt systems. With polyolefins, for example, the pressure and temperatures needed for the P/M fluid (which is approximately 100% solids after curing) are much lower than the pressures and temperatures needed to apply the same polyolefin in a melt process. There are many practical benefits due to this reduction of the viscosity of the coating material. These include the rate of production, reduced polymer degradation, reduced energy consumption, improved adhesion of the polymer to the fabric, and the uniformity of the thickness of the coating.

In many melt calendering operations for the coating of polymers onto fabrics, the rate of production is limited by the polymer melt viscosity. The high shear produced by rapid calendering of a high viscosity melt can produce a poor quality surface and high levels of internal strain within the coated system. Such internal strain can produce a non-uniformity in thickness coating and a tendency of the fabric to curl or pucker. In the traditional melt calendering application of polymers to fabric, the melt viscosity can be reduced by several techniques. These include increasing the melt temperature, lowering the molecular weight of the polymer, or adding a liquid plasticizer. All of these techniques reduce the quality of the product.

Increasing the temperature can lead to degradation of both the polymer and of the fabric substrate. Lowering the molecular weight produces adverse effects in the physical properties of the polymer. These include reduced strength, abrasion resistance, and weatherability. The use of a liquid plasticizer produces a final product that can be defective due to migration or extraction of the liquid.

The present invention allows for the fluid viscosity and temperature to be tailored to the specific needs of the process through control of the amount and nature of the polymerizable liquid that is added. This additive becomes a polymeric solid after the curing stage, which provides a distinctive quality advantage. The presence of this new polymer enhances the physical characteristics of the coated fabric, rather than reducing them as is the case with a conventional liquid plasticizer. The present invention allows for the preparation at higher rates of a coated fabric with enhanced properties, when the same polyolefin is used in both the conventional melt calendering and the P/M fluid calendering processes.

The application of the P/M fluid to a fabric by a melt extrusion application process is another way to use the present invention to produce coated fabrics. This application can be carried out in any of the several procedures currently used by those skilled in the art to extrusion coat fabrics with polymers (plastics and rubbers).

For superior results, the blending, mixing, compounding, coating and curing should all be carried out under a blanket atmosphere of inert gas without exposure of any of the ingredients or melt to adventitious air (oxygen).

There are significant process advantages to using P/M technology to extrusion coat fabric, relative to the use of conventional melt extrusion technologies. With polyolefins, for example, the pressure and temperatures need for the P/M fluid are lower than the pressures and temperatures needed to apply the same [polyolefin in a melt extrusion process. Temperature reduction of from 30 to 100 degrees Centigrade are possible and pressure reductions of from 100 to 5000 pounds per square inch (psi) are possible. Such reduction in both temperature and pressure make it easier and less expensive to produce a uniformly coated sample with good surface quality using the P/M extrusion process. Reduced cost is obtained both through faster production rates and through the use of less costly equipment (for example equipment that does not need as high a pressure rating as equipment needed for conventional melt extrusion fabric coating).

P/M Fluid Curing

After the P/M fluid is applied to the fabric substrate, a curing step is needed to develop the superior physical and chemical properties of this technology.

For superior results, the application and curing should be carried out under a blanket atmosphere of inert gas without exposure of the support (if any) or P/M fluid (melt) to adventitious air (oxygen).

This curing step involves the free radical polymerization of the liquid monomer. This process can also involve both a cross-linking of the forming polymer system and a copolymerization or graft polymerization that involves the preformed olefinic polymer.

Polyolefins with terminal double bonds, such as found in polyolefins made using single-site catalyst systems, are particularly suited for copolymerization with the polymerizing liquid polymer.

Various types of cross-linking monomers, for example acrylate esters of polyfunctional alcohols, can be incorporated into the system to increase the cross-link density. Such an increase in cross-link density will result in enhance physical properties such as toughness, abrasion resistance, and resistance to compression or tensile set.

The free radical polymerization process can be initiated in many ways. These include the use of thermal initiators (for example: 2,2'-azobis(isobutyronitrile), 2,5-dimethyl-2,5-di-(t-butylperoxy)hexane, di-t-butyl peroxide, dibenzoyl peroxide, and the like), the use of photochemical initiators (for example: benzildimethyl ketal, alpha hydroxy ketone, isopropylthioxanthone, benzophenone, and the like), and the use of energetic radiation, such a gamma rays. All three of these initiation techniques are practiced commercially.

Note that when free radical generation is accomplished, (for instance by thermal decomposition of peroxide or through the use of photochemical initiators or by exposure to electron beam or by exposure to gamma radiation, etc.), it is generally highly desirable to work in a closed system under an inert gas atmosphere (e.g., nitrogen) in an environment where effective precautions are taken to prevent significant contact with the atmospheric air (oxygen) in order that the resulting cured system has optimally enhanced physical properties. We have found that the pressure of air (oxygen) has a strongly detrimental effect on P/M polymerization processes so that it is advantageous to remove and exclude air as much as possible, both from the starting materials, additives, initiators, etc. and from the processing equipment including the feeders, etc. during blending mixing, compounding, application and coating.

In the thermal process, the coated fabric needs to be exposed to an elevated temperature for a period of time. The temperature needs to be high enough to cause the homolysis of the thermal initiator at a rate sufficient to generate a large flux of radicals. The time involved needs to be long enough to polymerize substantially all of the monomer. The exact times and temperatures needed can be tailored by careful selection of the initiator(s). It has been possible to achieve essentially complete polymerization of P/M system with polymer/monomer ratios from 95/5 to 40/60 (weight/weight) at 175 degrees Centigrade in 8 minutes. These are normal conditions used for curing PVC plastisol coated fabrics. As such fabrics made with the P/M technology can be cured in the same equipment under inert gas atmosphere at the same conditions used for PVC plastisol coated fabrics. Both higher and lower temperatures are practical (for example: from 120 degrees Centigrade to 210 degrees Centigrade, preferably from 150 degrees Centigrade to 190 degrees Centigrade), as are shorter and longer curing times (for example: from 1 minute to 60 minutes, preferably from 2 minutes to 20 minutes).

In the photo-induced free radical polymerization of the P/M system, the coated fabric in the "green" state is exposed to UV irradiation (for example: by irradiation with light in the 250 to 350 nanometer wavelength range) under inert gas atmosphere. The P/M coating in such a case must contain a photo-initiator (for example: benzildimethyl ketal). The photo curing can be done either in a continuous or batch operation, under inert gas atmosphere.

In a continuous process the fabric travels at a controlled rate through an exposure chamber under inert gas atmosphere where UV irradiation is provided over a moving belt. Alternatively a fabric sample could be placed in a stationary fashion under a UV lamp. The phase morphology of the resulting system is determined in part by the mobility of the P/M fluid at the time of the polymerization. Since such mobility is strongly affected by the temperature of the system, the resulting polymer morphology would expected to be different for a sample polymerized at over 130 degrees Centigrade for a thermal polymerization compared to a photo-polymerization carried out a below 50 degrees Centigrade. To control the morphology of the resulting sample it is possible to conduct a photo polymerization at elevated temperatures (for example: between 30 degrees Centigrade and 180 degrees Centigrade).

In high energy radiation curing, the "green" P/M coated fabric is exposed to radiation (for example: to radiation from a 60Co source, or from an electron beam, and the like) under inert gas atmosphere. In such a case no initiator needs to be added to the P/M system. Such curing can be done in continuous or batch fashion. It can also be done at a range of temperatures (for example: between 30 degrees Centigrade and 180 degrees Centigrade) to control the morphology of the resulting system.

As discussed in detail above, some of the polyalkene resins utilizable in the present invention include metallocene polypropylene, copolymers and terpolymers of ethylene made with single-site catalysts, copolymers and terpolymers of propylene made with single-site catalysts, blends of metallocene catalyzed polyolefins and their copolymers and terpolymers with other polymeric systems including corss-linked rubbers dispersed within or with the metallocene polyolefins, and blends of metallocene polyolefins with metallocene elastomers.

The composition of the phase A fluid may contain about 30 weight % to about 80 weight % polyalkene resin, while the phase B fluid may contain about 70 weight % to about 20 weight % of the second polymeric phase.

As also discussed herein, the second polymeric phase may be 90/10 (weight/weight) blend of lauryl methacrylate, trimethyolpropane triacrylate, blends of from 99 to 60 weight % of a monofunctional monomer and from 1 to 40% of a polyfunctional monomer, the monofunctional monomers including acrylate and methacrylate esters of alkyl alcohols that contain 8 or more carbon atoms, vinyl esters of alkyl acids that contain 8 or more carbon atoms, alpha olefins with 10 or more carbon atoms, the polyfunctional monomer being any material with two or more polymerizable functional groups that can polymerize with the monofunctional monomers.

EXAMPLE 1

A P/M fluid composed of 25% Exxon Exact 3017 metallocene polyethylene (Exxon Chemical Co., Houston, Tex.), 20% Sartomer SR 324 stearyl methacrylate (Sartomer Company, Exton, Pa.), 5% MP 8282 pentaerythritol tetraacrylate (Monomer-Polymer & Dajac, Feasterville, Pa.), 45% Martinal aluminum trihydrate (Lonza Inc., Newark, N.J.) and 5% Amgard MC ammonium polyphosphate (Albright and Wilson, Glen Allen, Va.) was prepared in a Welding Engineers (Welding Engineers Inc., Blue Bell, Pa.) 0.8 inch screw diameter twin screw extruder. All percentages cited are by weight. The solid components were added at the feed port with two feeders under a blanket of inert gas. One feeder delivered the Exact 3017 at 25 grams/minute and the other delivered a 9/1 blend of the aluminum trihydride/ammonium polyphosphate at 50 grams/minute. A 4/1 mix of stearyl methacrylate/pentaerythritol tetraacrylate was added under a blanket of inert gas by a piston pump at 25 grams/minute to a liquid injection port about half way down the extruder barrel. The extruder barrel temperatures were set at 150 degrees Centigrade up to the injection port and at 100 degrees Centigrade beyond that point. A screw speed of 200 revolutions per minute (RPM) was used. The fluid exited the extruder and went directly into a gear pump. From that pump it went through a Koch in-line mixing unit (Koch Engineering Company, Wichita, Kans.). Just before the in-line mixer, a stream of Lupersol 130 2,5-dimethyl-2,5-di (t-butylperoxy)-hexyne-3 (Atochem, Buffalo, N.Y.) was added with a piston pump at 1.5 grams/minute. Just after the in-line mixer the P/M fluid was spread by a die arrangement into the fluid reservoir in a "knife over roll" fabric coating station under nitrogen blanket. The temperature of the P/M fluid was controlled at 100 degrees Centigrade from the time it left the extrude through the time it was spread onto the fabric. At the knife coater, a nylon fabric was feed through the system at 1 meter per minute. The width of the coating was 0.5 meters. From the coating station the "green" coated fabric passed into an inert gas oven with forced circulation. In passing through this oven to a take up roll, the fabric was exposed to a temperature of 175 Centigrade for 8 minutes. The fabric was fully cured as it left the oven. The resulting polymer coated nylon fabric had excellent bonding between the fabric and polymer. This fire resistant coated fabric is suitable for fabrication into such items as tents or awnings.

EXAMPLE 2

Using the procedures described in Example 1, a P/M fluid composed of 60% SM 2350 Affinity metallocene catalyzed polyolefin (Dow Plastics, Midland, Mich.), 35% Sartomer SR 335 lauryl acrylate (Sartomer Company, Exton, Pa.) and 5% Sartomer SR 351 trimethylolpropane triacrylate (Sartomer Company, Exton, Pa.) was prepared. To this fluid was added 3 parts per hundred Trigonox C-t-butylperoxybenzoate (Akzo Nobel, Chicago, Ill.) based on the initial fluid weight.

The resulting material was spread coated onto a nylon fabric and subsequently oven cured at 170 degrees Centigrade for 15 minutes under nitrogen. The cured polymer coated fabric sample has a hard and clear surface with good adhesion between the fabric and the polymer.

EXAMPLE 3

A 250 gram sample of a P/M fluid composed of 162.5 grams of Exxon Exact 5008 metallocene catalyzed polyethylene (Exxon Chemical Company, Houston, Tex.), 30 grams of Sartomer SR 313 lauryl methacrylate (Sartomer Company, Exton, Pa.), and 12.5 grams MP 7956 trimethylol propane trimethacrylate (Monomer-Polymer & Dajac, Feasterville, Pa.) was prepared in a large laboratory Brabender internal mixer (C W Brabender Instruments Inc., South Hackensack, N.J.) under a blanket of nitrogen. The temperature of the mixing bowl was initially at 125 C but then reduced to 100 C when the polymer and monomers were added. After the fluid temperature reached 100 C and the fluid had taken on a uniform appearance, 2.0 grams of degassed Trigonox 101 2,5-(t-butylperoxy)-2,5-dimethyl hexane (Akzo Nobel, Chicago, Ill.) were added under nitrogen and allowed to mix into the fluid. The resulting catalyzed fluid was removed from the mixer and placed in a steel beaker heated to 100 degrees Centigrade under nitrogen. This material was then placed onto a 3 roll lab calendering mill with a sample of 5 inch wide cotton fabric going through. The mill gaps were set so as to produce a 0.5 mm coating of the "green" P/M polymer system on the fabric. From the resulting roll of "green" coated fabric a 12 inch length was cut. This sample was placed in an inert gas oven with forced circulation with a temperature of 160 degrees Centigrade. When the sample was removed after 20 minutes it was fully cured and had excellent adhesion to the fabric.

EXAMPLE 4

A P/M fluid composed of 76% Exxon Exact 4049 metallocene polyethylene (Exxon Chemical Company, Houston, Tex.), 20.3% Sartomer SR 313 Lauryl Methacrylate (Sartomer Company, Exton, Pa.), 2.5% Sartomer SR 351 Trimethylolpropane Trimethacrylate was compounded under nitrogen blanket in a Banbury at a temperature of approximately 130° F. for 15 minutes. Approximately 2 minutes before the end of the 15 minute period 1.15% of Trigonox 101 2,5-Dimethyl-2,5-di-(t-butylperoxy) hexane (Akzo Nobel Chemicals, Inc., Chicago, Ill.) was added under nitrogen. The resulting fluid was removed from the Banbury, formed into a sheet and cured at 275° F. for 15 minutes under nitrogen.

Measurement of the tensile properties gave the following data:

(1)M-PE (Exact 4049)

| | EXACT 4049 | LMA + TMPTA | Trigonox | Tensile Strength psi | Ultimate Elongation | Tear Strength | Hardness (Shore D) |
|---|---|---|---|---|---|---|---|
| Example 4 (under nitrogen) | 100 | 30 phr | 1.5 phr | 3040 | 730% | 250 | 22 |
| Example 4 (under air) | 100 | 35 phr | 12 phr | 1460 | 622 | 214 | 22 |
| (Reference) Exact 4049 (under nitrogen) | 100 | 0 | 0 | 1900 | 948% | 233 | 20 |

Clearly the tensile strength of the above product is enhanced relative to the basic physical properties of the "pure" metallocene polyethylene (3040 psi versus 1900 psi).

As indicated by the data in the above table, when the preparation of the above EXAMPLE 4 material is carried out in air, without the precaution of working in an inert atmosphere not only are the physical properties not improved, but they actually decrease and are degraded relative to the parent polyolefin (1460 psi versus 1900 psi).

EXAMPLE 4A

A P/M fluid composed of 82% Exxon ACHIEVE 3825 metallocene catalyzed isotactic polypropylene (Exxon Chemical Company, Houston, Tex.), 14.6% Sartomer SR 313 Lauryl Methacrylate (Sartomer Company, Exton, Pa.), 1.8% Sartomer SR 351 Trimethylolpropane Trimethacrylate was compounded under nitrogen blanket in a Banbury at a temperature of approximately 240 F for 15 minutes, Approximately 2 minutes before the end of the 15 minute period 1.2% of t-butylhydroperoxide (Akzo Nobel Chemicals, Inc., Chicago, Ill.) was added under nitrogen. The resulting fluid was removed from the Banbury, formed into sheet and cured at 375 F for 15 minutes under nitrogen. Measurement of the tensile properties gave the following data:

| | ACHIEVE 3825 | LMA + TMPTA | Peroxide | Tensile Strength psi | Ultimate Elongation | Tear Strength psi | Hardness (Shore D) |
|---|---|---|---|---|---|---|---|
| Example 4A (under nitrogen) | 100 | 20 phr | 1.5 phr | 4760 | 10% | 830 | 74 |
| Example 4A (under air) | 100 | 35 phr | 12 phr | 2010 | 3% | ND | 61 |
| (Reference) (under nitrogen) | 100 | 0 | 1.5 phr | 2900 | ND | 980 | 72 |

Clearly, again, the tensile strength of the above product is enhanced, when the preparation is carried out with the precaution of working in an inert atmosphere instead of in air (first and second examples in the above table.)

Comparison of the physical properties of the first and third examples in the above table, clearly demonstrate the benefit of P/M technology of the present invention. In particular, the tensile strength increased by 64% (4760 v. 2900 psi).

EXAMPLE 5

A P/M fluid composed of 60% Exxon Exceed 357C32 polypropylene (Exxon Chemical Company, Houston, Tex.), 30% Ageflex FM246 lauryl methacrylate (CPS Chemical Company, Old Bridge, N.J.), and 10% Sartomer SR 268 tetraethylene glycol diacrylate (Sartomer Company, Exton, Pa.) was prepared using the extruder procedure described in Example 1, under nitrogen. This fluid left the extruder, passed through an in-line mixer, and then was coated onto a moving role of polyester fabric using a melt die under nitrogen blanket. A stream of 2 parts per hundred of Trigonox B di-t-butyl peroxide (Akzo Nobel, Chicago, Ill.), based on the fluid, was added to the fluid just before the in-line mixer. The resulting green coated fabric was collected on a roll. In a subsequent step, this roll of coated fabric was feed through a continuous belt inert gas (nitrogen) oven with forced circulation. The oven was at 185 degrees Centigrade and the fabric had a residence time of 7 minutes. The resulting cured coated fabric had excellent adhesion between the polymer and the fabric. It also had good abrasion resistance.

EXAMPLE 6

A P/M fluid composed of 65% Santoprene 201-87 thermoplastic rubber (Advanced Elastomer Systems, Akron, Ohio), 25% Ageflex FM246 lauryl methacrylate (CPS Chemical Company, Old Bridge, N.J.), and 10% Sartomer SR 268 tetraethylene glycol diacrylate (Sartomor Company, Exton, Pa.) was prepared under nitrogen using the extruder procedure described herein. This fluid left the extruder, passed through an in-line mixer, and then was coated onto a moving role of polyester fabric using a melt die under nitrogen blanket. A stream of 1.5 parts per hundred of Trigonox B di-t-butyl peroxide (Akzo Nobel, Chicago, Ill.), based on the fluid, was added to the fluid just before the in-line mixer. The resulting green coated fabric was collected on a roll. In a subsequent step, this roll of coated fabric was feed through a continuous belt inert gas (nitrogen) oven with forced circulation. The oven was at 180 degrees Centigrade and the fabric had a residence time of 9 minutes. The resulting cured coated fabric had excellent adhesion between the polymer and the fabric. It also had good abrasion resistance.

Further examples of the present invention include one-step P/M, which includes but is not limited to extruded wire and cable, extruded pipe and blow-molded articles. One-step P/M is the formation of the P/M melt mixture followed by melt processing and the curing, all carried out in one continuous or batch process without cooling and isolation of the P/M mixture in the uncured or "green" state.

It is also part of the present invention to utilize a two-step P/M, examples of which include but are not limited to:

(a) forming uncured sheets of the P/M mixture, followed by subsequent remelting, vacuum thermoforming and curing (for instance to produce an automobile dashboard);

(a) forming uncured pellets of the P/M mixture, followed by injection molding and curing.

The two-step P/M includes forming the P/M melt mixture, cooling and isolating in the uncured stated, followed by subsequent heating, remelting, processing and curing in a separate operation.

Without further elaboration the foregoing will so fully illustrate our invention that others may, by applying current or future knowledge, adapt the same for use under various conditions of service.

We claim:

1. A process for preparing a coated material comprising the steps of:

(a) combining to form a homogeneous processable fluid comprised of:

(I) at least one polymer produced by a single site catalyst that produces terminal or chained reactive double bond sites, the polymer selected from the group consisting of polyolefin polymers, polyolefin copolymers, polyolefin terpolymers, aromatic polymers, and elastomers;

(ii) at least one polymerizable liquid selected from the group consisting of aromatic, aliphatic and cyclic hydrocarbons having one or more olefin, diene, triene, ester, nitrile, ketone, carboxylic acid, amide, amine and halide functional groups, the polymerizable liquid being compatible with the singe site catalyzed polymer at a processing temperature; and (iii) a means to generate free radicals under curing conditions;

(b) applying the processable fluid of step (a) to a substrate to produce a coated substrate; and (c) curing the coated substrate by free radical polymerization to produce a system substantially free of liquid monomer, wherein steps (a) through (c) are carried out in a substantially inert environment.

2. The process of claim 1 wherein the processable fluid is applied to the substrate by spread coating, calendering or extrusion.

3. The process of claim 2 wherein the curing step is performed by thermal, photochemical or radiation induced free radical polymerization.

4. A process as claimed claim 1 wherein the fluid additional comprises one or more additional materials such as fillers, fiber reinforcements, fire retardants, stabilizers, dyes, pigments, impact modifiers, processing aids, compatibilizers, blending aids, texturing aids and/or gas inclusions.

5. The process of claim 1 wherein step (a) comprises a melt mixing of from about 30 weight % to about 90 weight % of at least one single site catalyzed polymer and about 70 weight % to about 10 weight % of at least one polymerizable liquid which is compatible with the polyolefin at 100 degrees Centigrade and about 0.2 to about 15 parts per hundred of a compound that will initiate a free radical polymerization at 140 degrees Centigrade or higher but that will not induce polymerization at an appreciable rate at 120 degrees Centigrade or lower.

6. The process of claim 5 wherein the polymerizable liquid has a boiling point and a flash point above 100 degrees Centigrade.

7. The process of claim 1 wherein step (b) comprises application by knife of the coating composition fluid to a woven synthetic fabric.

8. The process of claim 1 wherein step (c) comprises thermal curing carried out at about 150 to about 190 degrees Centigrade.

9. The process of claim 1 wherein a monomer with several polymerizable groups is included in the monomer mixture to produce a cross-linked system upon curing.

10. The process of claim 1 wherein coating step (b) is accomplished using a rod coater.

11. The process of claim 1 wherein the coating step (b) is repeated at least two times to build up a multi-layer coated substrate, the multi-layers beings of the same or of different composition.

12. The process of claim 1 wherein a melt calendering process inert is used to coat a substrate having two sides, each of the two sides being coated simultaneously, wherein the coating composition fluid is applied to each of the two sides of the substrate, and wherein each of the two sides of the substrate is either of the same or of a different composition.

13. The process of claim 1 wherein the substrate is a fabric.

14. The process of claim 1 wherein the inert atmosphere comprises an inert gas.

15. The process of claim 14 wherein the inert gas comprises nitrogen, helium or argon.

* * * * *

US006017586C1

(12) EX PARTE REEXAMINATION CERTIFICATE (5501st)

United States Patent

Payn et al.

(10) Number: US 6,017,586 C1

(45) Certificate Issued: Sep. 12, 2006

(54) POLYMER MATERIAL AND METHOD OF MAKING SAME UTILIZING INERT ATMOSPHERE

(75) Inventors: Clyde F. Payn, Doylestown, PA (US); James Temple, Princeton, NJ (US)

(73) Assignee: Catalyst Group, Inc., Spring House, PA (US)

Reexamination Request:
No. 90/007,144, Jul. 29, 2004

Reexamination Certificate for:

| | |
|---|---|
| Patent No.: | **6,017,586** |
| Issued: | **Jan. 25, 2000** |
| Appl. No.: | **09/026,475** |
| Filed: | **Feb. 19, 1998** |

(51) Int. Cl.
*B05D 3/00* (2006.01)
*B05D 5/00* (2006.01)

(52) U.S. Cl. ..... 427/372.2; 427/211; 427/277; 427/288; 427/394

(58) Field of Classification Search ..... None
See application file for complete search history.

(56) References Cited

U.S. PATENT DOCUMENTS 4,143,468 A 3/1979 Novotny et al. ..... 34/1
4,632,944 A 12/1986 Thompson ..... 522/11
4,719,131 A 1/1988 Kemmerer et al. ..... 427/386

FOREIGN PATENT DOCUMENTS

WO WO 96/04419 A1 2/1996

OTHER PUBLICATIONS

Paul J. Flory, "Principles of Polymer Chemistry", Cornell University Press 1953.

Cheves Walling, "Free Radicals in Solution", John Wiley & Sons, Inc., 1957.

William A. Pryor, "Free Radicals", McGraw–Hill Book Company, 1966.

Calvin E. Schildknecht & Irving Skeist, "Polymerization Processes", John Wiley & Sons, Inc., 1977.

Graeme Moad & David H. Solomon, "The Chemistry of Free Radical Polymerization", Pergamon, 1995.

*Primary Examiner*—Jerry D Johnson

(57) ABSTRACT

The present invention relates to a polymer/monomer (P/M) formulated system and method of making products from that system. The products have superior properties to and are substitutable for polyvinyl chloride (PVC) based products, as well as a variety of other polymeric coating systems. The present invention also relates to a process for the preparation of these P/M based coated substrates where the process takes place in a substantially inert atmosphere.

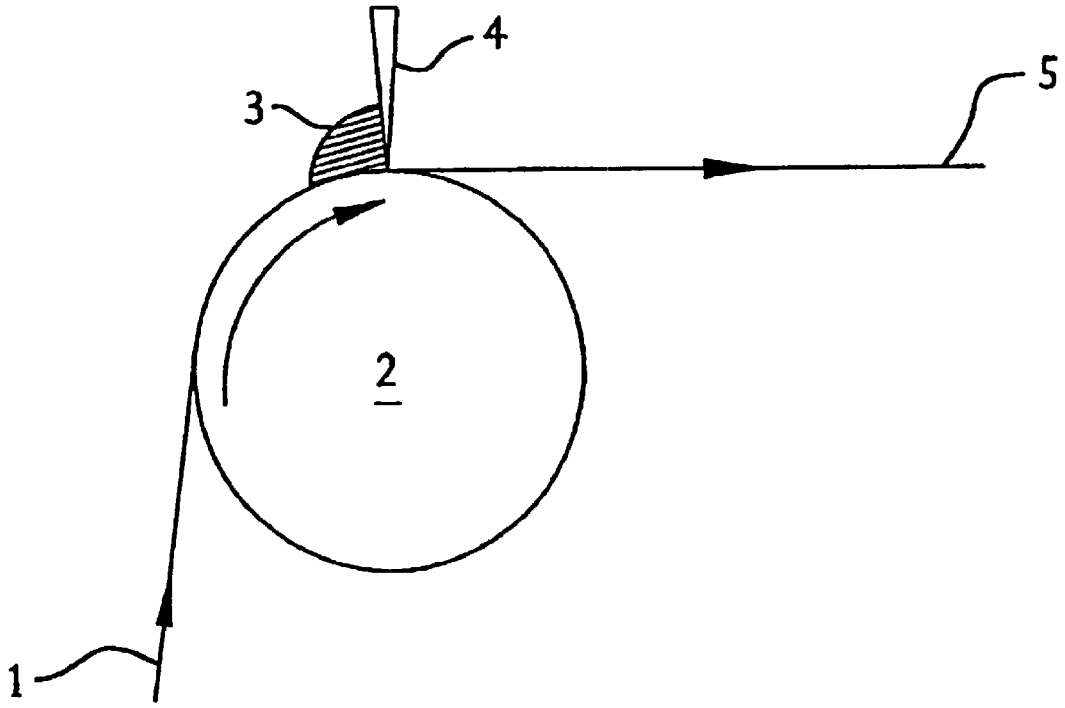

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–15 are cancelled.

* * * * *